US010955225B2

(12) United States Patent
Dunstan

(10) Patent No.: US 10,955,225 B2
(45) Date of Patent: Mar. 23, 2021

(54) PROJECTILE TARGET

(71) Applicant: Lokaway Pty Ltd, Cranbourne (AU)

(72) Inventor: Brett Dunstan, Cranbourne (AU)

(73) Assignee: Lokaway Pty Ltd., Cranbourne (AU)

( * ) Notice: Subject to any disclaimer, the term of this patent is extended or adjusted under 35 U.S.C. 154(b) by 0 days.

(21) Appl. No.: 16/339,906

(22) PCT Filed: Oct. 6, 2017

(86) PCT No.: PCT/AU2017/000211
§ 371 (c)(1),
(2) Date: Apr. 5, 2019

(87) PCT Pub. No.: WO2018/064710
PCT Pub. Date: Apr. 12, 2018

(65) Prior Publication Data

US 2020/0041235 A1 Feb. 6, 2020

(30) Foreign Application Priority Data

Oct. 6, 2016 (AU) ..... 2016904073

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... F41J 1/10; F41J 7/04
See application file for complete search history.

(56) References Cited

U.S. PATENT DOCUMENTS 1,415,823 A 5/1922 Fenton
2,967,712 A * 1/1961 Breitenfeldt ..... F41J 7/04 273/388
2006/0125185 A1 6/2006 Rolfe
(Continued)

FOREIGN PATENT DOCUMENTS

GB 453673 A 9/1936

OTHER PUBLICATIONS

International Search Report from the ISA/AU dated Dec. 5, 2017 for corresponding International Application No. PCT/AU2017/000211.
(Continued)

*Primary Examiner* — Jeffrey S Vanderveen
(74) *Attorney, Agent, or Firm* — Walter Haverfield LLP; Sean F. Mellino

(57) ABSTRACT

A projectile target 10 comprises a support structure 20 adapted to support two or more targets 30. The targets 30 are ideally off the ground 12, that is spaced from the ground 12. Each target 30 is, in turn, supported by an arm 32 extending from a common hinge 34. Each pair of targets 30 includes a first main target 30*a* and a second target 30*b*. In a first position 38*a*, the first target 30*a* presents a first broad target surface 36*a* to an operator or shooter (not shown). The second target 30*b* is displaced so that it does not present a viable target to the operator. However, the second target 30*b* is adapted to move into a second, viable, target position 38*b* when the first target 30*a* is struck substantially on its broad target surface 36*a* by a projectile, such as a .22 calibre bullet.

15 Claims, 5 Drawing Sheets

(56) References Cited

U.S. PATENT DOCUMENTS

| | | | | |
|---|---|---|---|---|
| 2011/0001292 | A1* | 1/2011 | Kreiman | F41J 7/04<br>273/386 |
| 2013/0207347 | A1 | 8/2013 | Sovine | |

OTHER PUBLICATIONS

Written Opinion of the International Searching Authority dated Dec. 5, 2017 for corresponding International Application No. PCT/AU2017/000211.

International Preliminary Report on Patentability from the IPEA/AU dated Sep. 25, 2018 for corresponding International Application No. PCT/AU2017/000211.

* cited by examiner

PROJECTILE TARGET

CROSS-REFERENCE TO RELATED APPLICATIONS

This application a 371 National Stage application of International Application No. PCT/AU2017/000211 filed on Oct. 6, 2017, which claims foreign priority to Australian (AU) Application Serial No. 2016904073 filed on Oct. 6, 2016, the contents of both of which are incorporated herein by reference in their entireties.

FIELD OF INVENTION

This invention relates to a projectile target. More particularly, this invention relates to a projectile target for non-exhaustively presenting a target for shooting practice.

BACKGROUND ART

The following references to and descriptions of prior proposals or products are not intended to be, and are not to be construed as, statements or admissions of common general knowledge in the art. In particular, the following prior art discussion should not be assumed to relate to what is commonly or well known by the person skilled in the art, but to assist in the inventive process undertaken by the inventor (s) and in the understanding of the invention.

Projectile targets have been described whereby the target, once hit, is deflected to a position in which it no longer presents a target. Other walker type targets generally comprise four-spaced targets in pairs of two targets in which the striking of one upstanding target of a pair causes the rotation of the walker whereby to present the targets of the other pair. However, such walker devices have the tendency to eventually assume a position in which the upstanding pair of targets present no viable target surface due to being rotated about 90 degrees relative to the shooter. Moreover, walker targets by their very nature are pushed further and further backwards, so that the shooting distance is variable.

An object of the present invention is to ameliorate the aforementioned disadvantages of the prior art or to at least provide a useful alternative thereto.

STATEMENT OF INVENTION

The invention according to one or more aspects is as defined in the independent claims. Some optional and/or preferred features of the invention are defined in the dependent claims.

Accordingly, in one aspect of the invention there is provided:

A projectile target comprising:

a support structure adapted to support multiple targets on a support surface, each target supported on a mounting arrangement, the targets including in a first position in which a first one of the targets presents a broad target surface to an operator and another of the targets is oriented so that it does not present a viable target, and a second position whereby the other of the target presents a broad target surface to the operator and the first target is oriented so that it does not present a viable target, the targets movable between the first and second positions by striking the target presenting the broad target surface with the projectile with sufficient force to displace the target presenting the broad target surface into the position in which it does not present a viable target and the other of the targets presents a broad target surface.

In another aspect, there is provided:

A projectile target comprising:

a support structure:

a plurality of targets;

wherein:

the support structure is adapted to support the plurality of targets on a support surface, each target is supported on its corresponding a mounting arrangement; the plurality of targets is adapted to assume:

a first position in which a first target of the plurality of targets presents a broad target surface to an operator and a second target of the plurality of targets is oriented so that it does not present a viable target; and a second position whereby the second target of the plurality of targets presents a broad target surface to the operator and the first target is oriented so that it does not present a viable target;

the first and second targets adapted to be movable between the first and second positions by striking the first or second target presenting the broad target surface with the projectile with sufficient force to displace the first or second target presenting the broad target surface into the first or second position in which the first or second target does not present a viable target and the other of the first and second targets presents a broad target surface.

In yet another aspect, there is provided:

A projectile target comprising:

a support structure adapted to support at least one pair of targets spaced from a support surface, each pair of targets in turn supported by an arm extending from a pivot arrangement, the pair of targets including a first target in a first position presenting a broad target surface to an operator a particular distance from the projectile target and a second target oriented so that it does not present a viable target, the second target being adapted to rotate into a viable target position on the first target being struck by a projectile shot by the operator with sufficient force to displace the first target to a second position, wherein the force required to move the first and second targets between the first and second positions corresponds to the force imparted by the projectile making a substantially direct hit on the broad target surface;

the first and second targets are biased to either the first or the second position and biased against any transitional position between the first and second positions.

In still another aspect, there is provided:

A projectile target comprising:

a support structure;

at least one support arm probably mounted to the support structure; and at least one pair of targets mounted to the at least one support arm, wherein:

the at least one pair of targets are the support structure is adapted to support the at least one pair of targets spaced from a support surface; each target of the pair of targets is supported by the at least one support arm extending from a pivot arrangement; the pair of targets is adapted to present a first one of the targets in a first position as a broad target surface to an operator a particular distance from the projectile target whereby a second one of the pair of targets is oriented so that it does not present a viable target; and the second target is adapted to rotate into a viable target position on the first target being struck by a projectile launched by the operator with sufficient force to displace the first target to a second position.

Preferably, the force required to move the first and second targets between the first and second positions corresponds to the force imparted by the projectile making a substantially direct hit on the broad target surface.

Preferably, the first and second targets are biased to either the first or the second position and biased against any transitional position between the first and second positions.

The support surface may be a hardstand, tarmac, floor, elevated stand or ground surface.

The projectile may be a weapon projectile, such as an arrow, dart or bullet. Preferably, the bullet is a non-fragmenting bullet suitable for target practice. The bullet may be a .22, .308, 9 mm, military grade or other standard calibre bullet. The bullet may be any one of the variety of standard weights for target practice, but typically will be the lighter bullet weights, such as 100-150 grains, suitable for target practice. For example, the operator may use a .22 calibre weapon capable of achieving exit speeds of between about 400-1000 m/s, and preferably about 600-about 700 m/s.

The projectile target may be placed at any desired distance from the operator, subject to safety precautions, rules of discharge, and local laws. For example, the target projectile may be spaced a distance of about 30 m-about 1000 m, depending on the proficiency of the operator. For lay-operators and for practice using short-barrel firearms, the shorter distances will be preferred, whereas a sporting shooter or military marksman may wish to set the projectile target at greater distances.

The support structure may include one or more of a vertical post, a diagonally extending member and a horizontal beam. The support structure is preferably configured to avoid impeding the movement of the targets, and may include cut-outs defining a travel path for the targets or preferably is of narrow construction still sufficiently robust to support the pivot arrangement. The support structure is preferably adapted to the positionally stable, in that strikes to the targets in use do not substantially shift the location of the support structure.

The mounting arrangement may include the pivot arrangement. The pivot arrangement may include a hinge or pivot point, or an arrangement of pivoting or hinged linkages. In each case the pivot arrangement may be adapted to toggle the pair of targets between two active first and second positions in which one or other of the first and second targets of the pair of targets presents the broad target surface.

The pair of targets may include a single intermediate hinge from which extends each arm of each target forming a group set of targets. The group set of targets are preferably connected whereby the displacement of the first target causes the second target to move into the second position.

In presenting a non-viable target, each target may be substantially planar in shape. By rotating a target substantially 90 degrees, the target can be toggled between a viable target presenting a broad target surface to a non viable target in which a slim or narrow side edge of the target faces the operator. Such a narrow target would be difficult to hit, hence its description as non-viable.

Each of the arms that support each target, or a group or set of targets, may be short in extent or long, to correspondingly space the target from the hinge. Accordingly, the arms of each set of targets may be identical in length or may be different in length. In particular, in the case where the support structure is substantially horizontal or inclined to the vertical, the length of each arm may be configured to provide a counter weight to ensure equally effective transition from the first to the second position.

Thus the length of the or each arm extending from a hinge point to a terminating target may be different for each member target of a set of targets. For example, an upper arm mounted to a substantially horizontal support structure may be elongate (longer) relative to a second arm supporting a lower target.

The shorter, in this case, lower, arm may be inversely proportionally heavier than the longer arm, per length of arm so that the long and short arms are balanced.

Preferably there are two targets in each set of targets mounted on a respective pair of arms having a common hinge or pivot point. The arms of each set of targets are preferably set at an angle of between 90-170 degrees. Each arm may be straight or arcuate. Where the set of targets is mounted to a horizontal beam, preferably the respective arms are of different length or, if of the same length, the respective arms are weighted differently, such as by having different thicknesses or different materials whereby to compensate for the effect of gravity on the pivoting of the pair of arms about a substantially horizontal axis.

In the case of a set of targets mounted to a vertical support structure, such as a substantially upright stand, the connected targets may be weighted and or spaced substantially identically. Preferably, the arms are angled at a slight inclination to the horizontal upwardly from the hinge or pivot point and are set at an angle relative to each other of between about 90 degrees-170 degrees. Accordingly, the effect of gravity on the weighted target sets causes one target or another of the set to rotate downwardly into position to present a broad target surface, the weighting of the set of targets being configured to urge, by gravity, one or other of the targets to move into a target-ready position.

The targets may include a wide variety of shapes, such as squares, circles, triangles, animal shapes, etc. Preferably, the target surface presented by each target of a set of targets is substantially identical.

The support structure preferably forms part of a frame. Preferably, the frame comprises a wide support base to ensure that the projectile target frame is relatively stable against projectile impacts, such that the target frame is preferably not dislodged or knocked over by such impacts, it being accepted that a projectile impact square on may cause the frame to either rock or be displaced a short distance away from the shooter. The support structure may be secured in the ground by integral spikes or separate pegs that engage with apertures in the frame base to temporarily fix the support structure at a particular location.

In another aspect, the invention provides:

Projectile target comprising at least one pair of targets, including a first target and a second target, the targets respectively are supported on a first arm and a second arm, whereby the first and second arms are joined and set at an obtuse angle relative to one another, whereby the common join of the first and second arms corresponds to a pivot point on which the pair of targets is mounted for pivotal rotation, the pair of targets mounted to a support structure whereby the first or second target presents a target surface to a shooter and the striking of one of the first and second targets displaces the struck target causing rotation of the pair of targets whereby to present the other of the first and second targets as a target surface, the first and second targets being non-exhaustively pivotable to always present at least one broad target surface to a shooter.

BRIEF DESCRIPTION OF THE DRAWINGS

The invention may be better understood from the following non-limiting description of preferred embodiments, in which.

DETAILED DESCRIPTION OF THE DRAWINGS

Figure 1A:
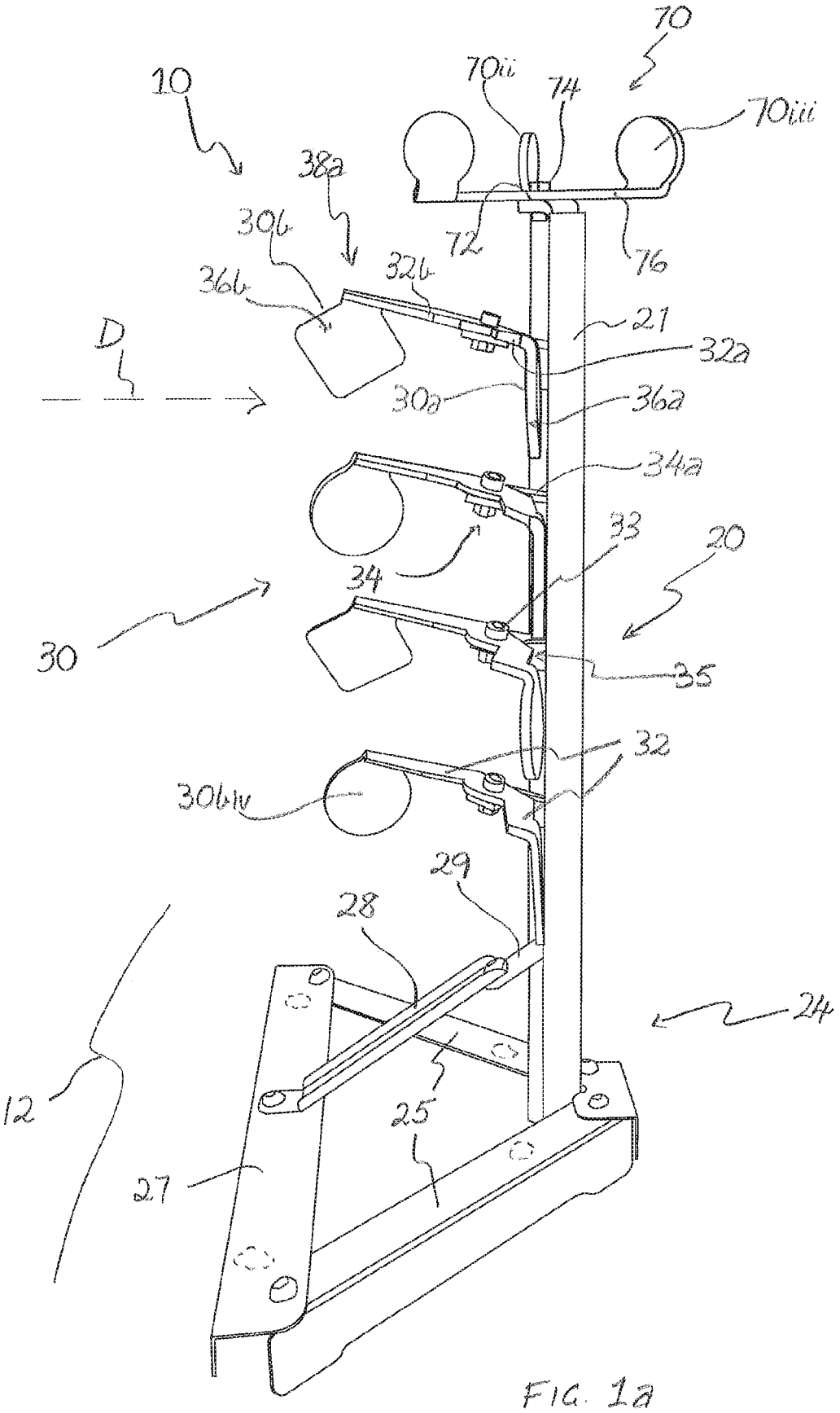
FIG. 1*a* is a side view of a projectile target according to a first embodiment.

Preferred features of the present invention will now be described with particular reference to the accompanying drawings. However, it is to be understood that the features illustrated in and described with reference to the drawings are not to be construed as limiting on the scope of the invention.

Referring to the first embodiment depicted in FIGS. 1-2, there is shown a projectile target 10 comprising a support structure 20 adapted to support two or more targets 30. The targets 30 are ideally off the ground 12, that is spaced from the ground 12. Each target 30 is, in turn, supported by an arm 32 extending from a common hinge 34.

Each pair of targets 30 includes a first main target 30*a* in a first position, facing the expected direction of approach of the projectile and a second target 30*b* oriented in a non-viable position angled such that it presents a narrow edge to the projectile approaching from direction D. In the first position 38*a*, the first target 30*a* presents a first broad target surface 36*a* to an operator or shooter (not shown). The second target 30*b* is displaced so that it does not present a viable target to the operator. However, the second target 30*b* is adapted to move into a second, viable, target position 38*b* when the first target 30*a* is struck substantially on its broad target surface 36*a* by a projectile, such as a .22 calibre bullet.

The projectile ideally hits the first target 30*a* with sufficient force to displace the first target 30*a* into the second position 38*b*. In the second position 38*b* the first target 30*a* does not present a viable target in that the first target is aligned side-on to an approach from direction D and presents a narrow profile. However, the second target 30*b* does present a second broad target surface 36*b* in the second position 38*b*.

The support structure 20 comprises a vertical post 21 that, in the field, is adapted to remain stationary on the ground or other support surface 12. The post 21 is mounted on a stationary base 24 that may comprise a heavy flat square or triangular plate made of metal or heavy polymeric material. The base may comprise three or more frame members and may include apertures 26 that may receive pegs (not shown) to stabilise the base 24 relative to the ground surface 12.

In preferred embodiment shown in FIGS. 1 and 2, the base 24 comprises a triangular frame comprising three base sections including a pair of bars 25 forming a V formation. The remote ends of each bar 25 are braced by a similarly horizontally aligned bar in the form of an L-section 27. The bars 25,27 lie in a substantially horizontal plane ("the base plane"). The post 21 is advantageously mounted in the crook of the V-formation and an inclined strut 28. The strut 28 is made of light channel section. The strut 28 extends from intermediate the length of the bar 27 upwardly to a location on the post 21 intermediate its length. Advantageously, the strut 28 is attached to a bracket 29 attached intermediate the length of the post 21, but below the lowermost set of targets 30*iv*. Alternatively, the post 21 may be attached by welds to the base 24. The post 21 ideally extends substantially upwardly from, and preferably normal to, to the base plane 24. In the embodiment shown, the post 21 is formed of angle iron. The mounting bracket for each hinge 34 may extend from a weld attachment in the crook of the L-section of the post 21.

Each pair of targets 30 comprises the first target 30*a* attached to the terminal end of an inclined arm 32*a*, and the second target 30*b* attached to the terminal end of an inclined arm 32*b*. Each arm is mounted to a hinge 34. The hinge 34 includes a hinge pin 33 that is rotatably inserted in a hinge body defining a bore in the hinge 34. The hinge 34 is aligned so that it is slightly inclined to the vertical. Therefore, the targets 30 are biased under the force of gravity to fall either to the first position 38*a* or the second position 38*b*.

There may be one or more pairs of targets 30 mounted on the post 21. The number of pairs is preferably between two and ten, and most preferably three to five pairs of targets 30 as shown in FIGS. 1 and 2. The pairs of targets 30 are aligned in series along the length of the post 21. The hinge pins 33 may be secured in the hinge bores 34 by cotter pins or circlips, etc. The hinge 34 comprises a lug 34*a* in the form of a bracket extending upwardly from the post 21 defining the bore and the hinge pin 33. The lug 39 may be welded to the side of the post 21. Alternatively, the post 21 and the hinge lugs 34*a* may be cast or moulded unitarily during manufacture.

The hinge pin 33 may be welded or otherwise unitarily or integrally formed with the arms 32. However, the hinge pin 33 may be a bolt and nut arrangement securing each pair 30 to the lug 34*a*. The arms 32*a,b* are inclined on a slight gradient of about 10-30 degrees to the horizontal, extending upwardly from the hinge pin 33. The arms 32 may extend substantially normal relative to the hinge pin 33. However, the arms may not necessarily be normal to the hinge pin 33. The arms 32 may extend in substantially the same plane inclined slightly relative to the post 21.

The first target 30*a* may be a square or diamond shaped plate. The second target 30*b* may be a discernibly different shape so that the set of targets 30 on an individual stand 20 may present multiple types of targets 30. The set of targets 30 may therefore comprise two or more types of targets 30. The first embodiment 10 may therefore be used for duelling in which each participating operator shoots for identifiably different targets 30. In a two-person competition, one person may shoot for the first type of targets 30*ai-iv* (see FIG. 1*b*), and the second operator may shoot for a second type of targets 30*bi-iv*. As each pair of targets 30 must present one or other of the types of targets 30*a* or 30*b* for the operators to aim at, the projectile target 10 may be used to indicate a winner after a predetermined number of shots allocated to each operator. By assessing how many of the pairs of, for example, targets 30 present the broad face of the first type of target 30*a* (in favour of the second operator) and how many present the broad face of the second type of target 30*b* (in favour of the second type of target 30*b*), the winner can be determined.

Figure 1B:
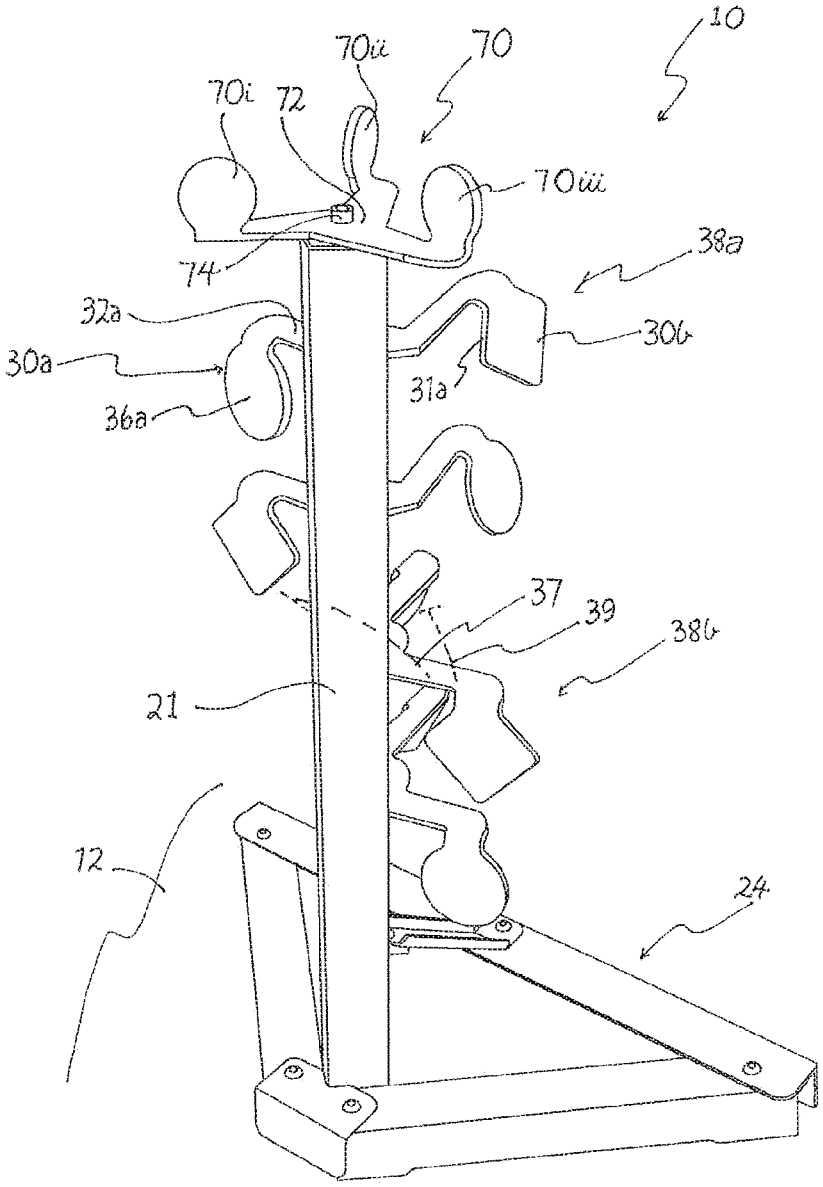
FIG. 1*b* is a front view of the projectile target of the first embodiment.
Figure 1C:
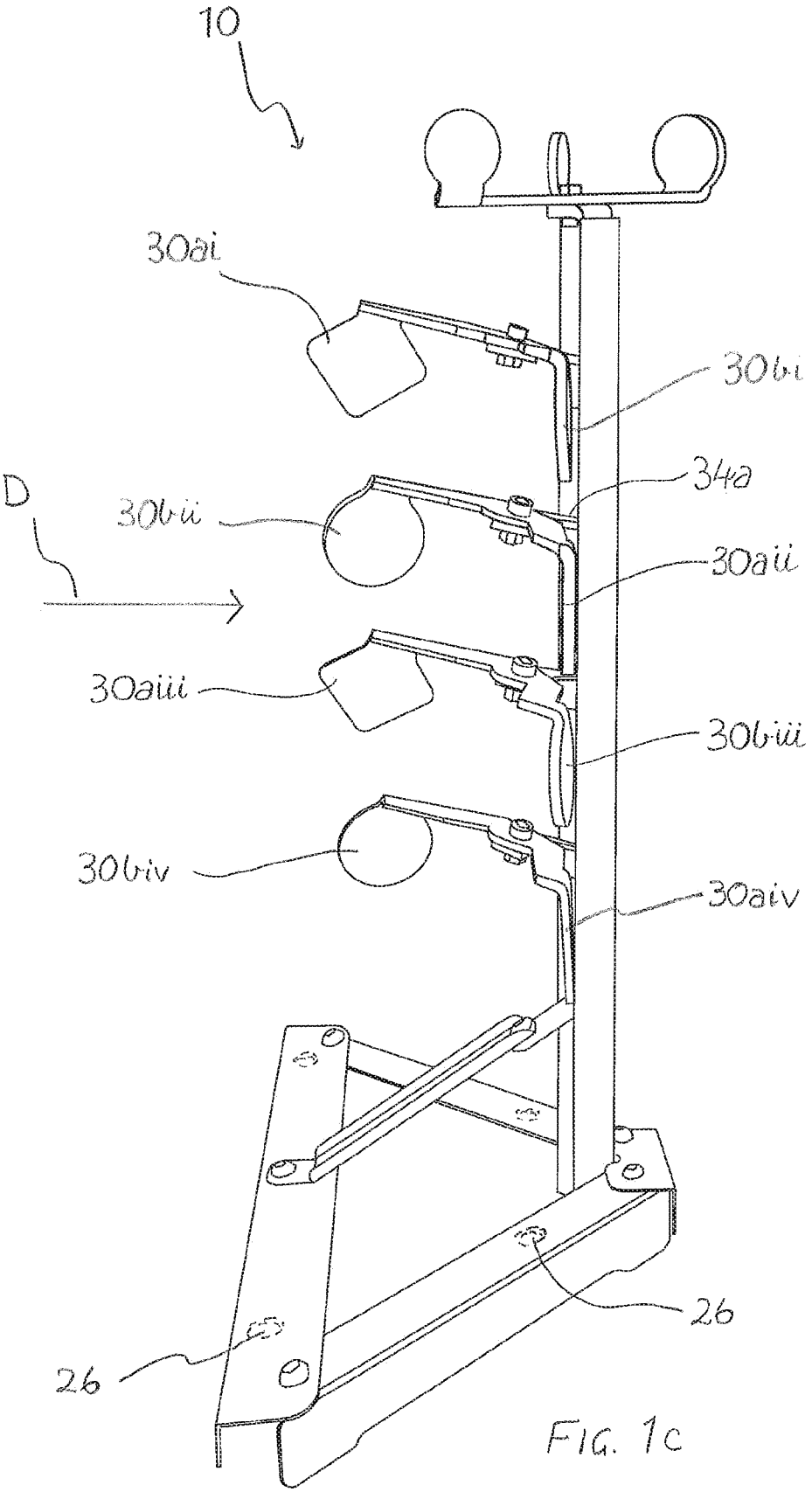
FIG. 1*c* is a side view of the projectile target of the first embodiment.

As shown in FIGS. 1*a-c*, the arms 32 are angled upwardly from the hinge 34 like branches of a conifer or pine tree. As the targets have the most potential energy against gravity when they are upper most, they are biased to fall to a lower first or second position 38*a,b* by falling sideways to the left or to the right. The hinge 34 has a detent upper rim or a formed shoulder 35 that limits the rotation of the pair of targets 30 beyond a limited arc 37. Advantageously, the detent 35 may comprise a broad edge of each of the arms 32 that is adapted to abut an edge of the post 21 at each corresponding first or second position 38*a,b*.

Accordingly, neither target 30*a,b* can travel over-centre where their height would reach a zenith if they were permitted to travel unhindered through the arc 37. As a consequence, the arms 32 travel through a limited arc 39 that is between about 20 to about 60 degrees rotation.

Atop the shaft 21 is a triplet set of targets 70 mounted for rotation about a substantially vertical axis. The triplet set of targets 70 comprise a central hub 72 mounted on a vertical spigot 74 and three radially and substantially horizontally extending, arms 76. The arms 76 are circumferentially equispaced, each arm 76 terminating in a target 70*i-iii*. As one target 70*i* is struck by a projectile, the target rotates until still. With three radially extending targets 70*i-iii*, at least one of the targets 70*i-iii* presents a broad target surface to the operator at any time.

Figure 2A:
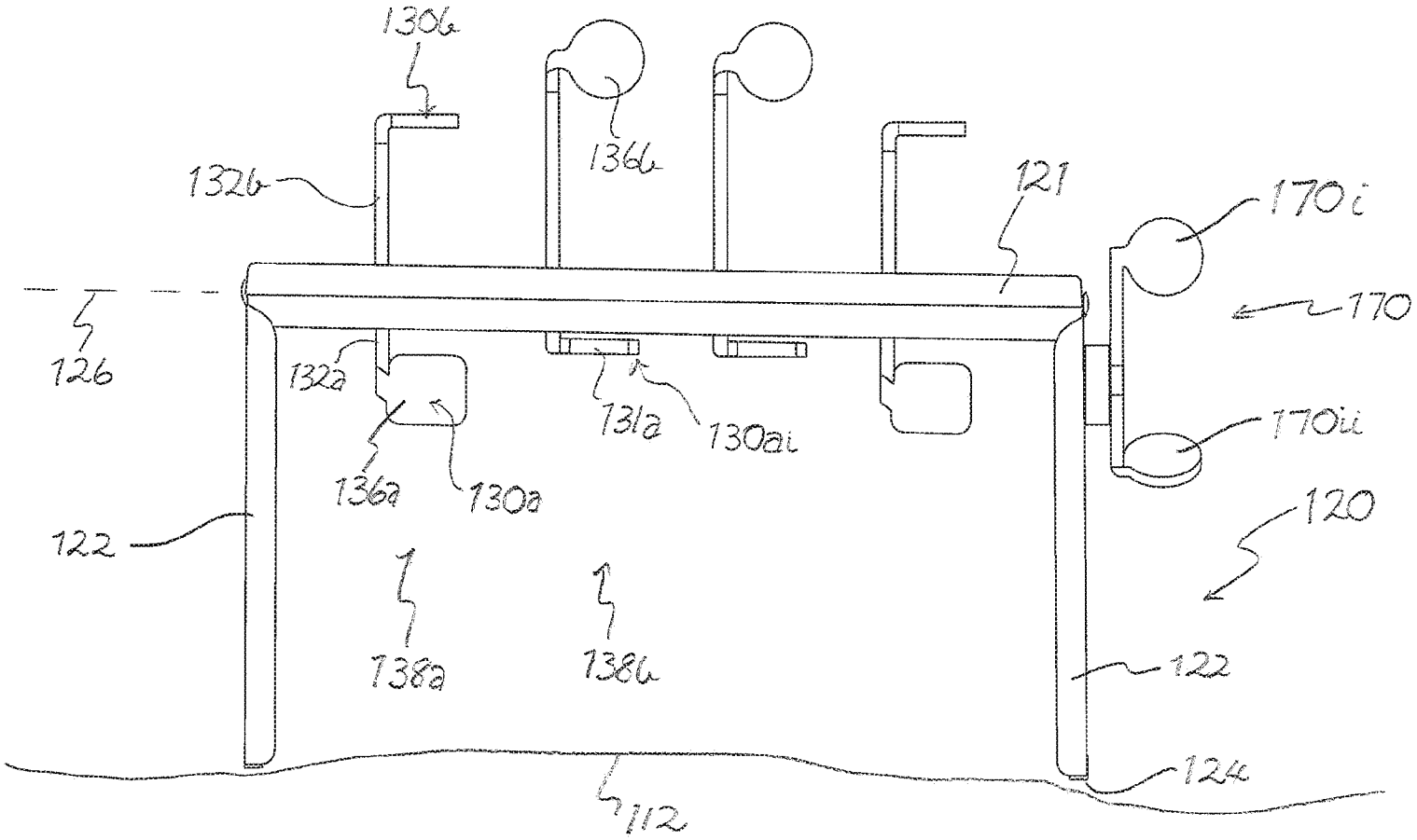
FIG. 2*a* is front view of a projectile target according to a second embodiment.
Figure 2B:
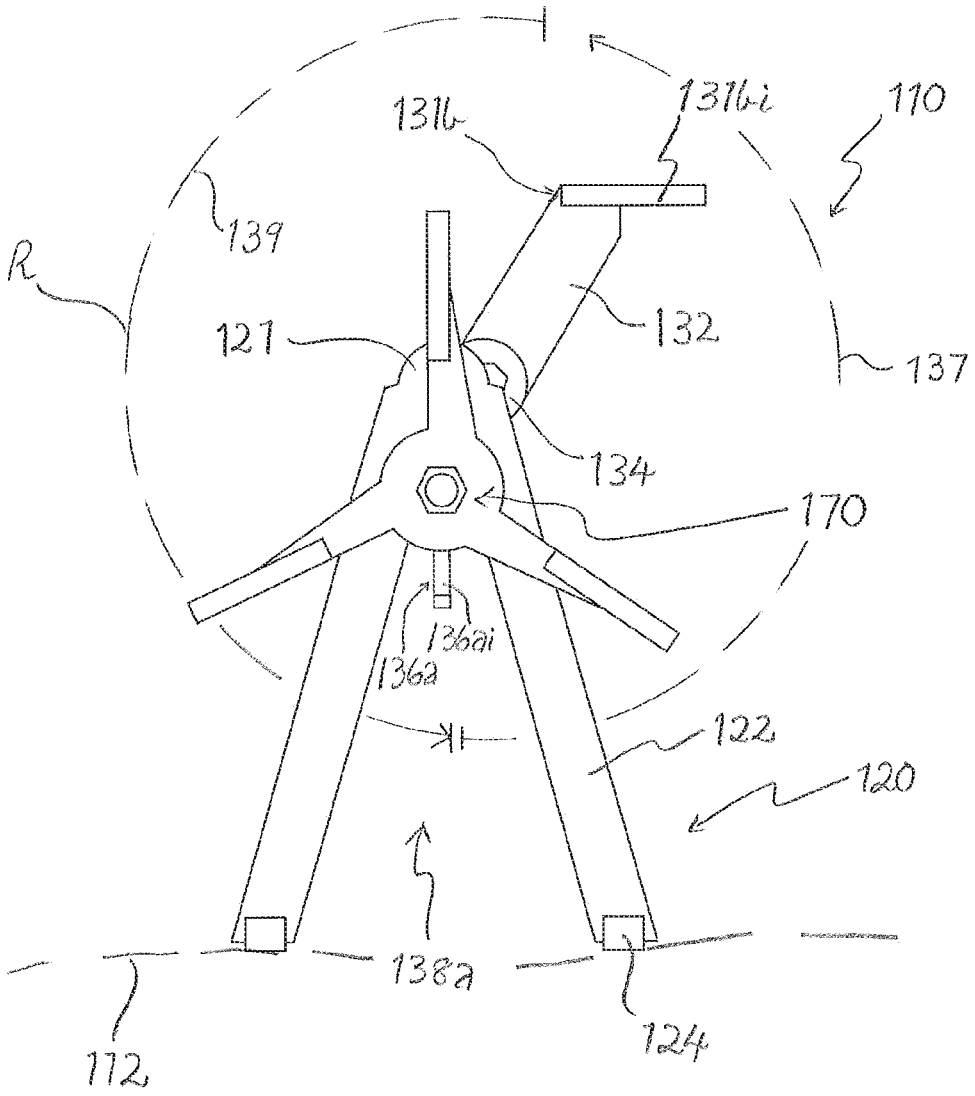
FIG. 2*b* is an end view of the projectile target of the second embodiment.

In FIGS. 2*a-b* there is shown a second embodiment 100 in which like features are referred to using like reference numerals (+100). The projectile target 100 comprises a support structure 120 comprising a substantially horizontal shaft 121, supported by side stands 122. The side stands are located at each end of the shaft 121 and have at their base 124 a horizontal bar or individual feet 124.

The shaft 122 has journalled sections spaced substantially equidistantly along its length on which are formed cylindrical bearing hinges 134. The hinges 134 adapted to rotate through a limited arc of travel 137 on a rear side of the stand 122. Fixedly attached to each of the hinges 134 is a pair of targets 130,*b* supported by arms 132 fixed to the outer surface of the hinge 134. The arms 132 terminate at a position spaced radially from the shaft axis 126 with target plates 130*a,b*. The arms 132 are limited to a rotational arm of about 50-80 degrees, and preferably about 60-70 degrees. Alternatively, the arms 132 are mounted to a bracket 134 about which the arms 132 and targets 130*a,b* rotate.

The upper target 130*a* is spaced a greater distance radially from the shaft 121 than the second target 130*b*, with the corresponding first arm 132*a* being appreciably longer than the second arm 130*b*. This provides correct weighting for the upper first target 130*a* to remain upright at its first position 138*a* without the second target 130*b* and arm 132*b* ensemble being heavy enough to cause the pair of targets 130*a,b* from rotating back down to the second position 138*b* shown in the second set of targets 130*ai,bi* in FIG. 2*a*. This is achieved by the length of the arms 132*a,b* being different, but could be achieved by varying the thickness of the shaft of each arm 132*a,b* or by adding a weighted sleeve to the upper arm 132*a*.

In any case, the lower arm 132*b* sits extant and cantilevered to the rear of the projectile target 100 from the hinge 134 and the shaft 121 in the first position 138*a*. The lower arm 132*b* should be light enough not to exert a leverage force on the target pair 130*a,b* sufficient to displace the pair of targets 130*a,b* from the first position 138*a*. In the second position 138*b*, when the upper target 130*a* is sufficiently impacted by a projectile to displace and force the upper target 130*a* backwards in the direction R, the force being transferred through the target 130*a* to the upper arm 132*a* to the hinge bearing 134, and then by fixed connection to the lower arm 132*b*. The lower arm 132*b* rotates down to the second position so that the second target 130*b* now presents a broad faced surface 136*b* and the first target is rotated so that only a slim edge profile 131*a* is presented to the operator as a non-viable target.

The targets 130*a,b* are therefore able to be toggled between the first and second positions 138*a,b* to provide the operator with an endless presentation of viable alternating targets 130*a,b*.

For clarity, only one set of targets 130 is shown in FIG. 2*b*, which shows the total arc 137 through which the pair of targets 130 travel and the limited arc of rotation 139 through which the lower target 130*b* travels. As the arms 132*a,b* are fixed to the hinge bearing 134, the arc of travel 139 of the upper arm 132*a* is equal and opposite to the arc of travel 137 of the lower arm 132*b*.

The weighting of the target and arm combinations are determined according to the impact energy or momentum likely to be generated by the intended projectile. The current invention is suitable for lighter rounds, such as air rifle slugs, through to .22 gauge bullets having weights of 120-150 grains. Each set of hinge or hub, arms and targets is advantageously cast in a single metal piece such as corrosion resistance stainless steel or aluminium, or galvanised or otherwise coated for weather protection.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

In the present specification, terms such as "apparatus", "means", "device" and "member" may refer to singular or plural items and are terms intended to refer to a set of properties, functions or characteristics performed by one or more items or components having one or more parts. It is envisaged that where an "apparatus", "means", "device" or "member" or similar term is described as being a unitary object, then a functionally equivalent object having multiple components is considered to fall within the scope of the term, and similarly, where an "apparatus", "assembly", "means", "device" or "member" is described as having multiple components, a functionally equivalent but unitary object is also considered to fall within the scope of the term, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the upper end of the post 21 or the uppermost target 130*a* uppermost It will be appreciated by those skilled in the art that many modifications and variations may be made to the methods of the invention described herein without departing from the spirit and scope of the invention.

The invention claimed is:

1. A projectile target comprising a support structure and a plurality of targets, the support structure being adapted to support the plurality of targets on a horizontal support surface, each target is supported on a corresponding mounting arrangement, the plurality of targets being adapted to assume:

a first position in which a first target of the plurality of targets presents a broad target surface to an operator and a second target of the plurality of targets is oriented so that it does not present a viable target; and a second position whereby the second target of the plurality of targets presents a broad target surface to the operator and the first target is oriented so that it does not present a viable target, the first and second targets being adapted to be movable between the first and second positions by striking the first or second target presenting the broad target surface with a projectile with sufficient force to displace the first or second target presenting the broad target surface into the first or second position in which the first or second target does not present a viable target and the other of the first and second targets presents a broad target surface, wherein:

the mounting arrangement includes a pivot arrangement on which both the first and second targets are respectively attached to terminal ends of an inclined arm, the location of the terminal ends of the inclined arm being fixed relative to each other when the inclined arm is stationary as well as through a range of motion of the inclined arm which places the first and second targets in either the first or second position, the inclined arm mounted to a hinge; and the hinge is aligned so that it is slightly inclined to the vertical so that the targets are biased under the force of gravity to fall either to the first position or to the second position; wherein when the first target moves to the first position the second target must move to not present a viable target; wherein when the second target moves to the second position the first target must move to not present a viable target.

2. The projectile target of claim 1, wherein the force required to move the first and second targets between the first and second positions corresponds to the force imparted by the projectile making a direct hit on the broad target surface.

3. The projectile target of claim 1, wherein the first and second targets are biased against any transitional position between the first and second positions.

4. The projectile target of claim 1, wherein the projectile is a weapon projectile.

5. The projectile target of claim 1, wherein the support structure includes a vertical post.

6. The projectile target of claim 5, wherein the hinge includes a bracket defining a hinge bore for a hinge pin, the bracket extending upwardly from the post.

7. The projectile target of claim 5, wherein the detent comprises a broad edge of the arm that is adapted to abut an edge of the post at the corresponding first or second position.

8. The projectile target of claim 6, wherein the inclined arms extend normal relative to the hinge pin.

9. The projectile target of claim 6, wherein the inclined arms extend in the same plane and are inclined slightly relative to the post.

10. The projectile target of claim 1, wherein the pivot arrangement is adapted to toggle the pair of the first and second targets between two active positions in which one or other of the targets of the pair of targets presents the broad target surface.

11. The projectile target of claim 1, wherein the hinge comprises a single intermediate hinge from which extends each inclined arm of each target forming a group set of connected targets.

12. The projectile target of claim 11, wherein the group set of targets are connected whereby the displacement of the first target causes the second target to move into the first or the second position in which the first or second target presents the broad target surface.

13. The projectile target of claim 1, wherein the length of each inclined arm is configured to provide a counter weight to ensure equally effective transition from the presentation of the first target compared to the rotation required to present the second target.

14. The projectile target of claim 1, wherein the first and second targets are non-exhaustively pivotable to always present at least one of the broad target surfaces to a shooter.

15. The projectile target of claim 1, wherein the hinge has a detent that limits the rotation of the pair of targets beyond a limited arc.

* * * * *